US009857773B1

(12) United States Patent
Tang

(10) Patent No.: US 9,857,773 B1
(45) Date of Patent: Jan. 2, 2018

(54) SMART WATCH AND MULTIPLE NUMERICAL OPERATION METHOD THEREOF

(71) Applicant: Wuhan China Star Optoelectronics Technology Co., Ltd., Wuhan (CN)

(72) Inventor: Yuejun Tang, Wuhan (CN)

(73) Assignee: WUHAN CHINA STAR OPTOELECTRONICS TECHNOLOGY CO., LTD., Wuhan, Hubei (CN)

( * ) Notice: Subject to any disclaimer, the term of this patent is extended or adjusted under 35 U.S.C. 154(b) by 0 days.

(21) Appl. No.: 15/245,187

(22) Filed: Aug. 24, 2016

(30) Foreign Application Priority Data

Jun. 20, 2016 (CN) ..... 2016 1 0446715

(51) Int. Cl.
*G04G 9/00* (2006.01)
*A44C 5/14* (2006.01)

(52) U.S. Cl.
CPC ..... *G04G 9/0088* (2013.01); *A44C 5/14* (2013.01); *G04G 9/0035* (2013.01)

(58) Field of Classification Search
CPC .... G04G 17/045; G04G 17/04; G04G 9/0017; G04G 9/0088; G04G 9/0035; G04G 9/00; A44C 5/14
See application file for complete search history.

(56) References Cited

U.S. PATENT DOCUMENTS 8,014,635 B2 * 9/2011 Kondo ..... G06F 1/1616 382/312
2008/0318636 A1 * 12/2008 Kim ..... G06F 1/163 455/566
2011/0019370 A1 * 1/2011 Koh ..... H01L 21/561 361/749
2014/0142403 A1 * 5/2014 Brumback ..... A61B 5/02433 600/324
2014/0254111 A1 * 9/2014 Yamazaki ..... H01L 51/0097 361/749
2016/0029473 A1 * 1/2016 Zang ..... H01L 27/1218 361/749
2016/0124395 A1 * 5/2016 Lee ..... G04G 17/045 368/239
2016/0291641 A1 * 10/2016 Doyle ..... G06F 1/1652
2016/0357158 A1 * 12/2016 Kim ..... G06F 1/163
2017/0068225 A1 * 3/2017 Chen, Jr. ..... G04G 19/00

* cited by examiner

*Primary Examiner* — Sean Kayes
(74) *Attorney, Agent, or Firm* — Leong C. Lei

(57) ABSTRACT

The invention discloses a smart watch, which comprises: a dial (10), a first and a second strap (20, 24), connected respectively to both sides of the dial (10), a main display (12) disposed on a front of the dial (10), a first secondary display (13) disposed on the end of the first strap (20) connected to the dial (10), and a second secondary display (14) disposed on the end of the second strap (24) and connected to the dial (10) to increase the display area of the smart watch to achieve complex human machine interaction to satisfy various demands for display by the users. By using monolithic manufacturing method, the invention achieves reducing the number of control circuit and cost. The present invention provides a multiple numerical operation method for smart watch is easy to operate and can enhance user experience.

6 Claims, 5 Drawing Sheets

SMART WATCH AND MULTIPLE NUMERICAL OPERATION METHOD THEREOF

BACKGROUND OF THE INVENTION

1. Field of the Invention

The present invention relates to the field of display technique, and in particular to a smart watch and multiple numerical operation method thereof.

2. The Related Arts

In recent years, the liquid crystal display (LCD) and organic light-emitting diode (OLED) display have replaced the cathode ray tube (CRT) and become the mainstream display technology; wherein the LCD is the most widely used and has the largest market share. On the other hand, the OLED display has the advantages of active light-emitting, low driving voltage, high emission efficiency, quick response time, high resolution and contrast, near 180° viewing angle, wide operation temperature range, and capability to realize flexible display and large-area full-color display, and is regarded as the most promising display technology.

As the formats of the electronic products become versatile for various demands, the wearable smart devices become the newest trend after the smart phone. The wearable smart devices are getting popular due to convenience. The most common wearable devices are eyeglasses, hat, and watches, wherein the most common wearable smart device is the smart watch, which provides users with more revolutionary experience. Most known smart watch can be connected to mobile phones, to provide users with news and e-mail reminders, and can achieve a certain degree of Internet access. In addition, as smart watch is worn on the user's wrist, the smart watch can easily measure the wearer's blood pressure, heart rate, body temperature and other data, to achieve health and fitness monitoring and greatly improve the life quality.

The known smart watches are generally equipped with a separate display screen, which is often reduced in size to provide easy wearing. With the increasing complexity of smart watch functions, a larger display screen is desirable to achieve effective human machine interaction, which the known smart watch with single screen cannot satisfy.

SUMMARY OF THE INVENTION

The object of the present invention is to provide a smart watch, with large display area, ability to achieve complex human machine interaction, satisfying versatile demands on display by the user, reducing the number of control circuit, saving cost and improving product quality.

Another object of the present invention is to provide a multiple numerical operation method for smart watch, which is easy to operate and enhance user experience.

To achieve the above object, the present invention provides a smart watch, which comprises: a dial, a first strap and a second strap, connected respectively to both sides of the dial, a main display disposed on a front of the dial, a first secondary display disposed on the end of the first strap connected to the dial, and a second secondary display disposed on the end of the second strap and connected to the dial.

According to a preferred embodiment of the present invention, the first strap is disposed with a plurality of clasps; and the second strap is disposed with a plurality of clasp holes corresponding to the plurality of clasps.

According to a preferred embodiment of the present invention, the main display has a size larger than the first secondary display and the second secondary display; the main display displays dynamic images, while the first secondary display and the second secondary display display static images.

According to a preferred embodiment of the present invention, the main display, the first secondary display and the second secondary display are monolithically made from a display motherboard, and are controlled by the same control circuit.

According to a preferred embodiment of the present invention, the display motherboard is a flexible OLED display motherboard; the display motherboard comprises: a substrate, a light-emitting layer disposed on the substrate, an encapsulation layer disposed on the substrate surrounding the light-emitting layer, and a control circuit connection area disposed on the substrate outside of the layer encapsulation layer; the substrate being a flexible substrate, comprising a first light-emitting area, a first bending area, a second light-emitting area, a second bending area, and a third light-emitting area disposed consecutively; the light-emitting layer covering the first light-emitting area, the second light-emitting area and the third light-emitting area, and being disposed with a trench corresponding to the locations of the first bending area and the second bending area; the light-emitting layer covering the first light-emitting area, the second light-emitting area and the third light-emitting area being electrically connected through metal wires of the trench; the display motherboard having a bend at the first bending area and a second bending area respectively, and being connected to a control circuit through the control circuit connection area to form the main display, the first secondary display and the second secondary display.

According to a preferred embodiment of the present invention, a desiccant is disposed on the first bending area and the second bending area.

According to a preferred embodiment of the present invention, the display motherboard is a flexible OLED display motherboard; the display motherboard comprises: a substrate, a light-emitting layer disposed on the substrate, an encapsulation layer disposed on the substrate surrounding the light-emitting layer, and a control circuit connection area disposed on the substrate outside of the layer encapsulation layer; the substrate being a flexible substrate, comprising a first light-emitting area, a first bending area, a second light-emitting area, a second bending area, and a third light-emitting area disposed consecutively; the light-emitting layer covering the first light-emitting area, the second light-emitting area and the third light-emitting area; the display motherboard having a bend at the first bending area and a second bending area respectively, and being connected to a control circuit through the control circuit connection area to form the main display, the first secondary display and the second secondary display.

According to a preferred embodiment of the present invention, the main display, the first secondary display, and the second secondary display are all independent displays.

The present invention also provides a multiple numerical operation method for smart watch, which comprises the steps of: Step 1: providing a smart watch, comprising: a dial, a first strap and a second strap, connected respectively to both sides of the dial, a main display disposed on a front of the dial, a first secondary display disposed on the end of the first strap connected to the dial, and a second secondary display disposed on the end of the second strap and connected to the dial; Step 2: performing a first numerical operation, displaying a process and a result of the first numerical operation on the main display, moving the result of the first numerical operation to one of the first or second secondary displays; Step 3: performing a second numerical operation, displaying a process and a result of the second numerical operation on the main display, moving the result of the second numerical operation to the other of the first or second secondary displays; and Step 4: performing a numerical operation on the results displayed on the first and second secondary displays, and displaying a process and a result of the numerical operation on the main display to accomplish the multiple numerical operations.

According to a preferred embodiment of the present invention, in Step 2 and Step 3, the moving of the result of the first and second numerical operations is achieved by gesture, moving an image or pressing a button.

The present invention provides the following advantages: the present invention provides a smart watch, which comprises: a dial, a first strap and a second strap, connected respectively to both sides of the dial, a main display disposed on a front of the dial, a first secondary display disposed on the end of the first strap connected to the dial, and a second secondary display disposed on the end of the second strap and connected to the dial, and the first and the second secondary display able to assist the main display for displaying. Compared to the known technology, the present invention improves the display area of the smart watch so that the smart watch can achieve complex human machine interaction to satisfy various demands for display by the users. By making the main display, the first secondary display and the second secondary display monolithically from a display motherboard, and being controlled by the same control circuit, a single common control circuit connection area and a control circuit can be disposed to control the main display, the first secondary display and the second secondary display to achieve reducing the number of control circuit and improving product quality. The present invention provides a multiple numerical operation method for smart watch, using the above smart watch to display the process and result of a single numerical operation on the main display, and move the result to the first or second secondary display; then the present invention displays the process and result of the final numerical operation on the main display, which is easy to operate and can enhance user experience.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technical means and effect of the present invention, the following refers to embodiments and drawings for detailed description.

Figure 1:
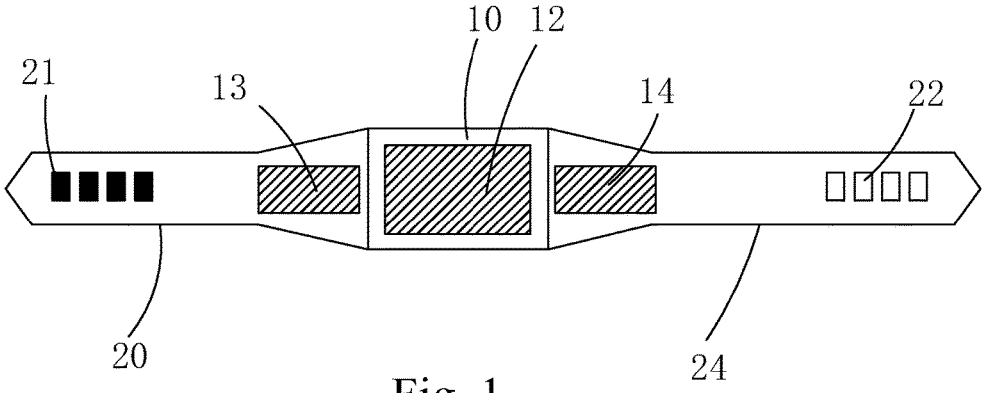
FIG. 1 is a schematic view showing the structure of the smart watch provided by a first embodiment of the present invention.
Figure 2:
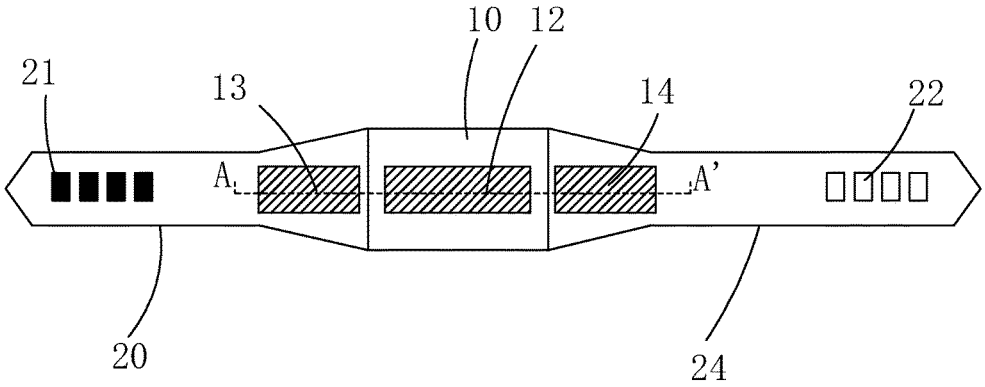
FIG. 2 is a schematic view showing the structure of the smart watch provided by a second embodiment of the present invention.
Figure 3:
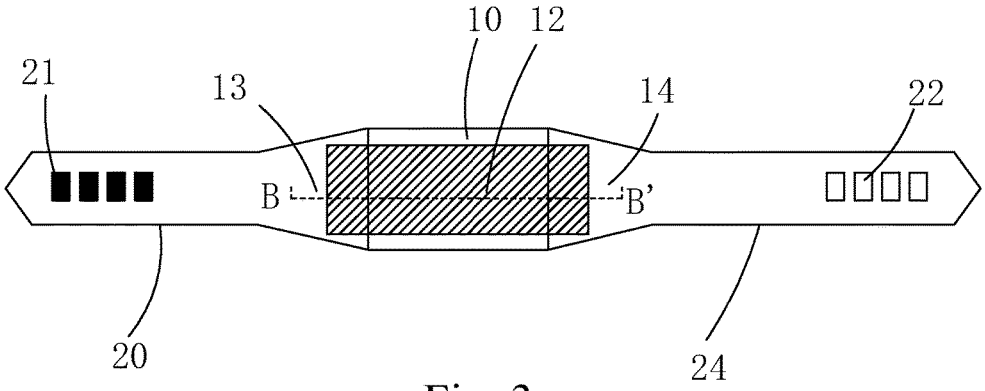
FIG. 3 is a schematic view showing the structure of the smart watch provided by a third embodiment of the present invention.

Refer to FIGS. 1-3. the present invention provides a smart watch, which comprises: a dial 10, a first strap 20 and a second strap 24, connected respectively to both sides of the dial 10, a main display 12 disposed on a front of the dial 10, a first secondary display 13 disposed on the end of the first strap 20 connected to the dial 10, and a second secondary display 14 disposed on the end of the second strap 24 and connected to the dial 10.

Specifically, the smart watch is a smart device installed with a smart operating system, able to connect wirelessly to a mobile phone and to Internet to provide users with news and e-mail reminders, as well as to measure the wearer's blood pressure, heart rate, body temperature and other data, to achieve health and fitness monitoring.

Specifically, the first strap 20 and the second strap 24 are disposed with fixation structure for convenient wearing. Preferably, the first strap 20 is disposed with a plurality of clasps 21; and the second strap 24 is disposed with a plurality of clasp holes 22 corresponding to the plurality of clasps 21. With the clasps 21 and the clasp holes 22, the user can wear the smart watch.

Specifically, the first secondary display 13 and the second secondary display 14 can assist the main display 12 for displaying.

Specifically, the shape and size of the main display 12, the first secondary display 13 and the second secondary display 14 can vary according to applications. The main display 12, the first secondary display 13 and the second secondary display 14 may have the same shape or different shapes. The main display 12, the first secondary display 13 and the second secondary display 14 can be of the same size or different sizes. Moreover, the first secondary display 13 and the second secondary display 14 can also be of the same size or different sizes.

Optionally, refer to FIG. 1. In the first embodiment of the smart watch of the present invention, the main display 12, the first secondary display 13 and the second secondary display 14 are all rectangular. The size of the main display 12 is larger than the size of the first secondary display 13 and the size of the second secondary display 14. At this point, the aspect ratio of the main display 12 is better than the first secondary display 13 and the second secondary display 14; and the main display 12 displays complex dynamic images, while the first secondary display 13 and the second secondary display 14 display simple static images. For example, the main display 12 plays a video, the first secondary display 13 displays the title of the playing video and the second secondary display 14 display the current time.

Optionally, the size of the main display 12 can be equal to or smaller than the size of the first secondary display 13 and the size of the second secondary display 14.

Specifically, the present invention uses the first and the second secondary displays 13, 14 to assist the main display 12 for displaying to greatly increases the display area of the smart watch so that the smart watch can achieve complex human machine interaction to satisfy various demands for display by the users.

Specifically, the main display 12, the first secondary display 13 and the second secondary display 14 can be independent displays, which are controlled respectively by three control circuits; alternatively, the main display 12, the first secondary display 13 and the second secondary display 14 can be made monolithically by a display motherboard and controlled by the same control circuit. The control circuit is an integrated circuit (IC).

Preferably, refer to FIG. 2 and FIG. 3. In the second and third embodiments of the present invention, the main display 12, the first secondary display 13 and the second secondary display 14 can be made monolithically by a display motherboard 100 and controlled by the same control circuit.

Figure 4:
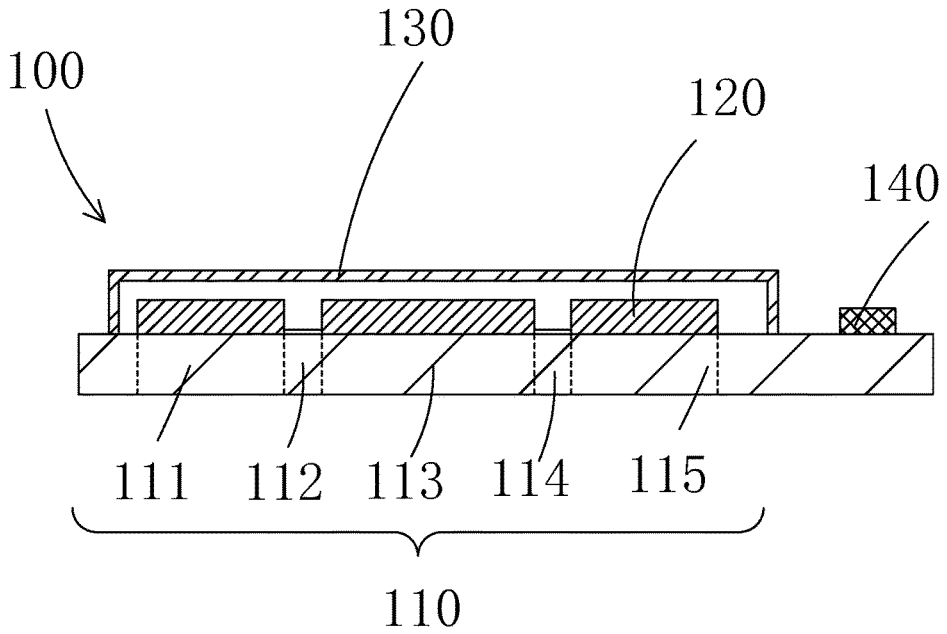
FIG. 4 and FIG. 5 are cross-sectional views of A-A' showing the smart watch provided by the second embodiment of the present invention in FIG. 2.

Specifically, refer to FIG. 2 and FIG. 4. In the second embodiment of the present invention, the display motherboard 100 is a flexible OLED display motherboard. Refer to FIGS. 4-7. The display motherboard 100 comprises: a substrate 110, a light-emitting layer 120 disposed on the substrate 110, an encapsulation layer 130 disposed on the substrate 110 surrounding the light-emitting layer 120, and a control circuit connection area 140 disposed on the substrate 110 outside of the layer encapsulation layer 130. Preferably, in the second embodiment, the main display 12, the first secondary display 13 and the second secondary display 14 have the same width. However, the above condition is illustrative, instead of restrictive. The main display 12, the first secondary display 13 and the second secondary display 14 can have different widths depending on applications.

Wherein, the substrate 110 is a flexible substrate, and comprises a first light-emitting area 111, a first bending area 112, a second light-emitting area 113, a second bending area 114, and a third light-emitting area 114, disposed consecutively.

The light-emitting layer 120 covers the first light-emitting area 111, the second light-emitting area 113 and the third light-emitting area 115, and is disposed with a trench corresponding to the locations of the first bending area 112 and the second bending area 114, respectively.

The light-emitting layer 120 coverings the first light-emitting are 111, the second light-emitting area 113 and the third light-emitting area 115 is electrically connected through metal wires of the trench.

The display motherboard 100 has a bend at the first bending area 112 and a second bending area 114, respectively, so that the first light-emitting area 111, the second light-emitting area 113 and the third light-emitting area 115 are located on the first strap 20, the dial 10 and the second strap 24, respectively. Also, by connecting to a control circuit through the control circuit connection area 140, the same control circuit can respectively control the main display 12, the first secondary display 13 and the second secondary display 14 corresponding respectively to the first light-emitting are 111, the second light-emitting area 113 and the third light-emitting area 115.

Figure 5:
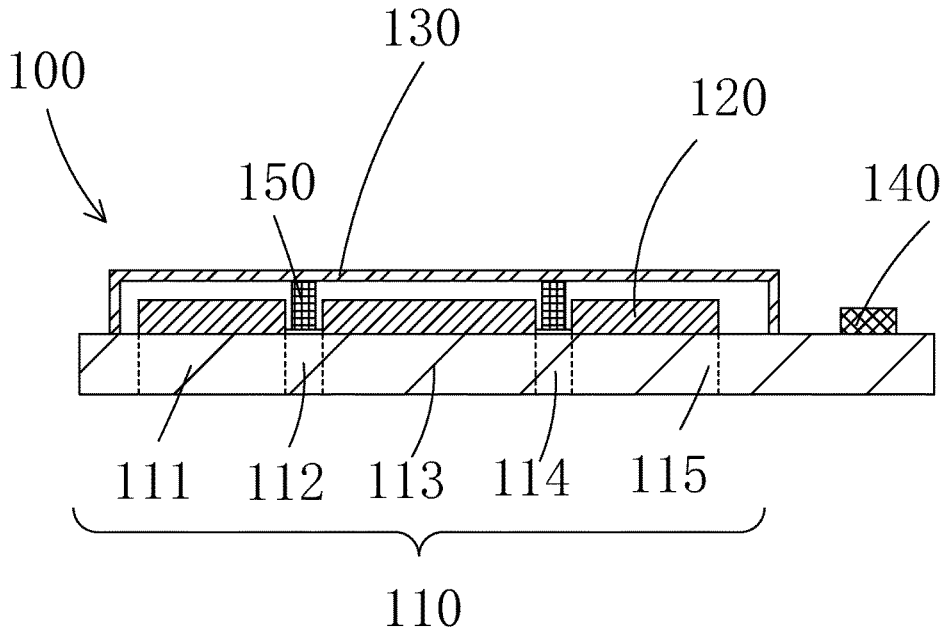

Optionally, refer to FIG. 5. In the second embodiment, when the display motherboard 100 ha a wider bend or twist at the locations of the first bending area 112 and the second bending area 114, a desiccant 150 can be disposed on the first bending area 112 and the second bending area 114 to improve the humidity absorption of the displays to protect the light-emitting layer 120 and expand the lifespan of the displays.

Figure 6:
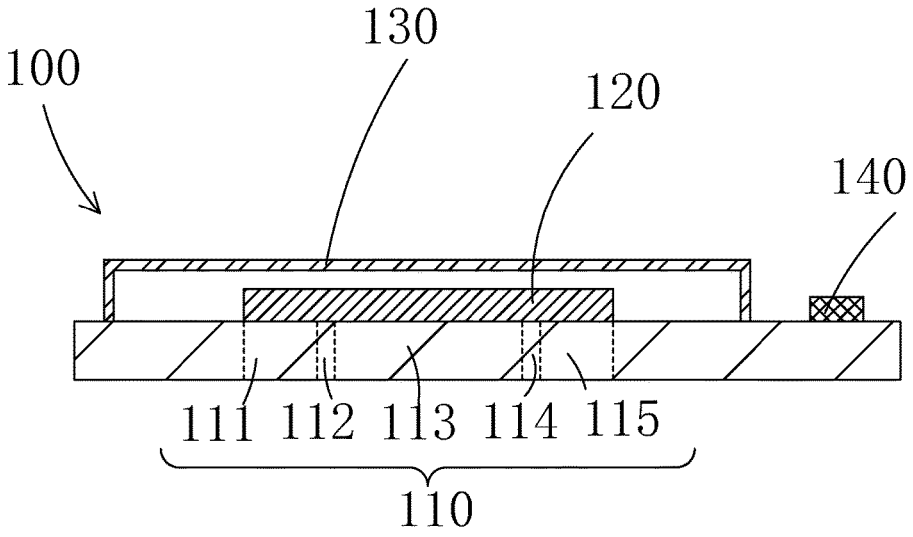
FIG. 6 is a cross-sectional views of B-B' showing the smart watch provided by the third embodiment of the present invention in FIG. 3.

Specifically, refer to FIG. 3 and FIG. 6. FIG. 6 shows a schematic view of the structure of the OLED display motherboard in the third embodiment of the present invention. The third embodiment differs from the second embodiment in that the light-emitting layer 120 covers the first light-emitting area 111, the first bending area 112, the second light-emitting area 113, the second bending area 114, and the third light-emitting area 115. The display motherboard 100 has a bend at the first bending area 112 and a second bending area 114, respectively, and by connecting to a control circuit through the control circuit connection area 140, the same control circuit can respectively control the main display 12, the first secondary display 13 and the second secondary display 14 corresponding respectively to the first light-emitting are 111, the second light-emitting area 113 and the third light-emitting area 115.

Figure 7:
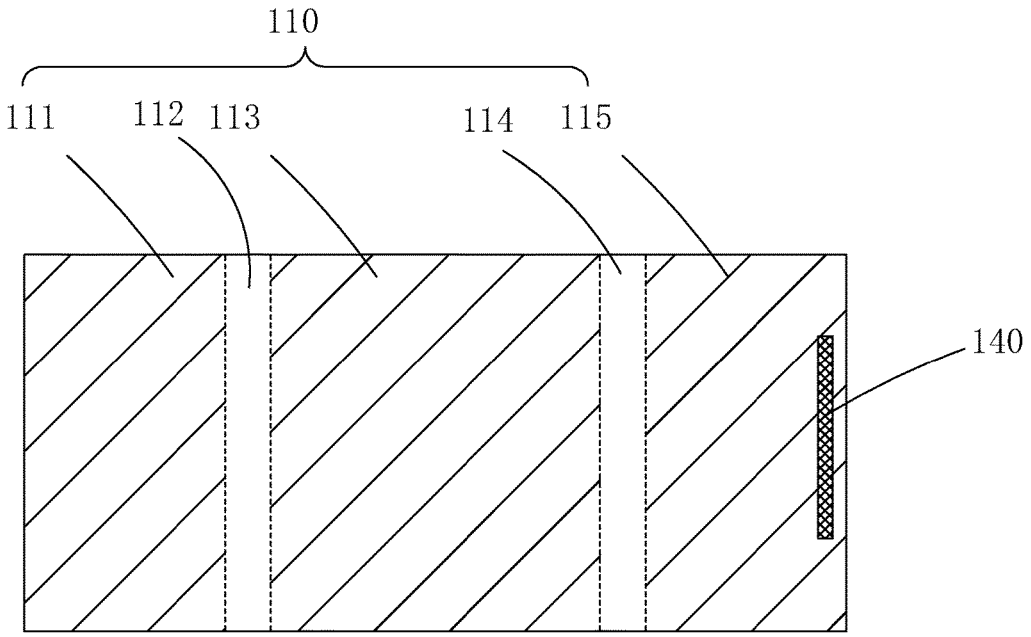
FIG. 7 is a schematic view showing the location of the control circuit connection area in the OLED display motherboard of the smart watch provided by the second embodiment of the present invention.
Figure 8:
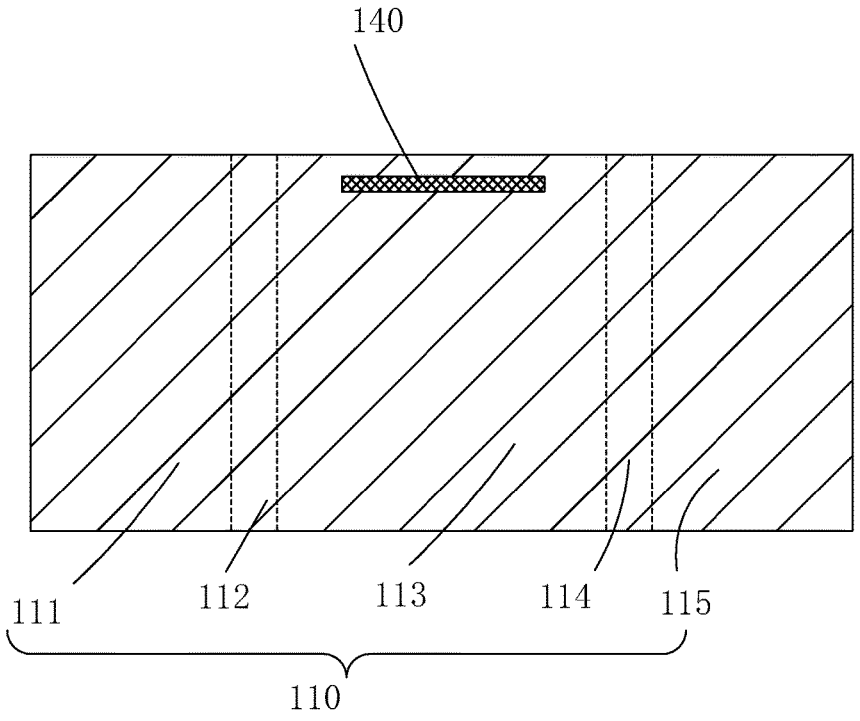
FIG. 8 is a schematic view showing the location of the control circuit connection area in the OLED display motherboard of the smart watch provided by the third embodiment of the present invention.

It should be noted that, referring to FIG. 7 and FIG. 8 for the second and third embodiments of present invention, the location of the control circuit connection area 140 can vary according to applications. The location can be at the two ends of the first light-emitting area 111 or the third light-emitting area 115, or at two sides of the second light-emitting area 113. As shown in FIG. 7, the control circuit connection area 140 in the second embodiment is disposed at the right end of the third light-emitting area 115; or as shown in FIG. 8, the control circuit connection area 140 in the third embodiment is disposed at the upper side of the second light-emitting area 113. In other words, the control circuit connection area 140 can be disposed corresponding to the first secondary display 13, the main display 12 or the second secondary display 14. The main display 12, the first secondary display 13, and the second secondary display 14 are all controlled by the same control circuit, which effectively reduces the number of control circuit and improve product quality.

Figure 9:
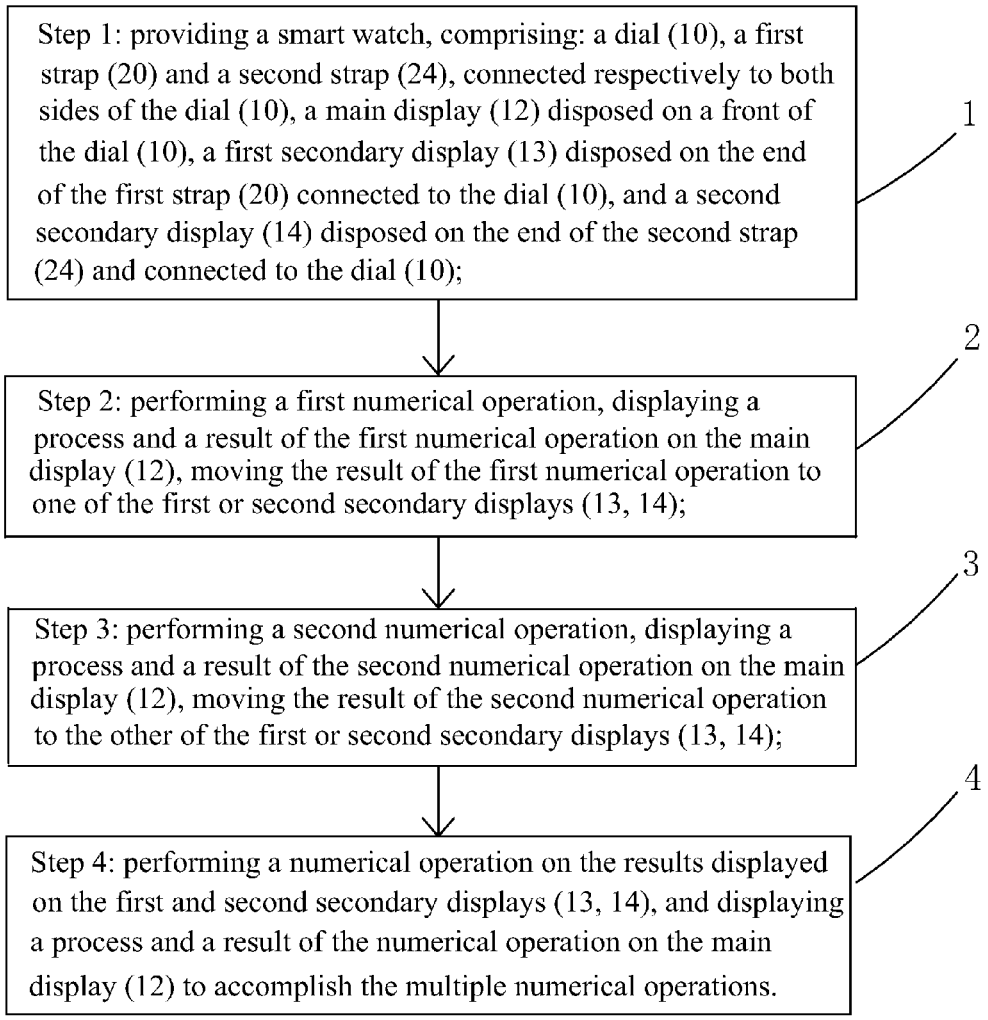
FIG. 9 is a schematic view showing the flowchart of the multiple numerical operation method of smart watch provided by an embodiment of the present invention.

Refer to FIG. 9. Based on the above smart watch, the present invention also provides a multiple numerical operation method for smart watch, which comprises the steps of:

Step 1: providing a smart watch; the smart watch is as aforementioned, and will not be described here.

Step 2: performing a first numerical operation, displaying a process and a result of the first numerical operation on the main display 12, moving the result of the first numerical operation to one of the first or second secondary displays 13, 14.

For example, if the first numerical operation is the sum of 625+322, the main display 12 displays "625+322=947". Then, the result is moved to the first secondary display 13. Specifically, the first secondary display 13 displays "A=947".

Specifically, the result of the first numerical operation can be moved by gesture, moving an image or pressing a button from the main display 12 to the first secondary display 13.

Step 3: performing a second numerical operation, displaying a process and a result of the second numerical operation on the main display 12, moving the result of the second numerical operation to the other of the first or second secondary displays 13, 14.

For example, if the second numerical operation is the quotient of 4 and 1.2, the main display 12 displays "4/1.2=3.333". Then, the result is moved to the second secondary display 14. Specifically, the second secondary display 14 displays "B=3.333".

Specifically, the result of the second numerical operation can be moved by gesture, moving an image or pressing a button from the main display 12 to the second secondary display 14.

Step 4: performing a numerical operation on the results displayed on the first and second secondary displays 13, 14, and displaying a process and a result of the numerical operation on the main display 12 to accomplish the multiple numerical operations.

For example, the first secondary display 13 displays "A=947", and the second secondary display 14 displays "B=3.333". The final numerical operation is the quotient of the result of the first numerical operation and the result of the second numerical operation, and then the main display 12 displays "A/B=284, which accomplishes the multiple numerical operations.

The multiple numerical operation method of smart watch displays the process and the result of each single numerical operation on the main display 12, and then moves the result of each single numerical operation to the first or second secondary displays 13, 14. When both the first and the second secondary displays 13, 14 display the results, the main display 12 displays the numerical operation on the results displayed on the first and the second secondary displays 13, 14 to obtain the result of the multiple numerical operation result. As such, the method is convenient, easy to operate and able to enhance user experience. The smart watch of the present invention is, not only restricted in enhancing user experience regarding multiple numerical operations, but also able in other areas depending on the application.

In summary, the present invention provides a smart watch, which comprises: a dial, a first strap and a second strap, connected respectively to both sides of the dial, a main display disposed on a front of the dial, a first secondary display disposed on the end of the first strap connected to the dial, and a second secondary display disposed on the end of the second strap and connected to the dial, and the first and the second secondary display able to assist the main display for displaying. Compared to the known technology, the present invention improves the display area of the smart watch so that the smart watch can achieve complex human machine interaction to satisfy various demands for display by the users. By making the main display, the first secondary display and the second secondary display monolithically from a display motherboard, and being controlled by the same control circuit, a single common control circuit connection area and a control circuit can be disposed to control the main display, the first secondary display and the second secondary display to achieve reducing the number of control circuit and improving product quality. The present invention provides a multiple numerical operation method for smart watch, using the above smart watch to display the process and result of a single numerical operation on the main display, and move the result to the first or second secondary display; then the present invention displays the process and result of the final numerical operation on the main display, which is easy to operate and can enhance user experience.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A smart watch, which comprises: a dial (10), a first strap (20) and a second strap (24), connected respectively to both sides of the dial (10), a main display (12) disposed on a front of the dial (10), a first secondary display (13) disposed on the end of the first strap (20) connected to the dial (10), and a second secondary display (14) disposed on the end of the second strap (24) and connected to the dial (10);

wherein the main display (12), the first secondary display (13) and the second secondary display (14) are monolithically made from a display motherboard (100), and are controlled by the same control circuit; and wherein the display motherboard (100) is a flexible organic light-emitting diode (OLED) display motherboard;

the display motherboard (100) comprises: a substrate (110), a light-emitting layer (120) disposed on the substrate (110), an encapsulation layer (130) disposed on the substrate (110) surrounding the light-emitting layer (120), and a control circuit connection area (140) disposed on the substrate (110) outside of the layer encapsulation layer (130);

the substrate (110) being a flexible substrate, comprising a first light-emitting area (111), a first bending area (112), a second light-emitting area (113), a second bending area (114), and a third light-emitting area (115) disposed consecutively;

the light-emitting layer (120) covering the first light-emitting area (111), the second light-emitting area (113) and the third light-emitting area (115), and being disposed with a trench corresponding to the locations of the first bending area (112) and the second bending area (114);

the light-emitting layer (120) covering the first light-emitting area (111), the second light-emitting area (113) and the third light-emitting area (115) being electrically connected through metal wires of the trench; and the display motherboard (100) having a bend at the first bending area (112) and a second bending area (114) respectively, and being connected to a control circuit through the control circuit connection area (140) to form the main display (12), the first secondary display (13) and the second secondary display (14).

2. The smart watch as claimed in claim 1, wherein the first strap (20) is disposed with a plurality of clasps (21); and the second strap (24) is disposed with a plurality of clasp holes (22) corresponding to the plurality of clasps (21).

3. The smart watch as claimed in claim 1, wherein the main display (12) has a size larger than the first secondary display (13) and the second secondary display (14); the main display (12) displays dynamic images, while the first secondary display (13) and the second secondary display (14) display static images.

4. The smart watch as claimed in claim 1, wherein a desiccant (150) is disposed on the first bending area (112) and the second bending area (114).

5. A multiple numerical operation method for smart watch, which comprises the steps of:

Step 1: providing a smart watch, comprising: a dial (10), a first strap (20) and a second strap (24), connected respectively to both sides of the dial (10), a main display (12) disposed on a front of the dial (10), a first secondary display (13) disposed on the end of the first strap (20) connected to the dial (10), and a second secondary display (14) disposed on the end of the second strap (24) and connected to the dial (10);

Step 2: performing a first numerical operation, displaying a process and a result of the first numerical operation on the main display (12), moving the result of the first numerical operation to one of the first or second secondary displays (13, 14);

Step 3: performing a second numerical operation, displaying a process and a result of the second numerical operation on the main display (12), moving the result of the second numerical operation to the other of the first or second secondary displays (13, 14); and Step 4: performing a numerical operation on the results displayed on the first and second secondary displays (13, 14), and displaying a process and a result of the numerical operation on the main display (12) to accomplish the multiple numerical operations;

wherein the main display (12), the first secondary display (13) and the second secondary display (14) are monolithically made from a display motherboard (100), and are controlled by the same control circuit; and wherein the display motherboard (100) is a flexible organic light-emitting diode (OLED) display motherboard;

the display motherboard (100) comprises: a substrate (110), a light-emitting layer (120) disposed on the substrate (110), an encapsulation layer (130) disposed on the substrate (110) surrounding the light-emitting layer (120), and a control circuit connection area (140) disposed on the substrate (110) outside of the layer encapsulation layer (130);

the substrate (110) being a flexible substrate, comprising a first light-emitting area (111), a first bending area (112), a second light-emitting area (113), a second bending area (114), and a third light-emitting area (115) disposed consecutively;

the light-emitting layer (120) covering the first light-emitting area (111), the second light-emitting area (113) and the third light-emitting area (115), and being disposed with a trench corresponding to the locations of the first bending area (112) and the second bending area (114);

the light-emitting layer (120) covering the first light-emitting area (111), the second light-emitting area (113) and the third light-emitting area (115) being electrically connected through metal wires of the trench; and the display motherboard (100) having a bend at the first bending area (112) and a second bending area (114) respectively, and being connected to a control circuit through the control circuit connection area (140) to form the main display (12), the first secondary display (13) and the second secondary display (14).

6. The multiple numerical operation method for smart watch as claimed in claim 5, wherein in Step 2 and Step 3, the moving of the result of the first and second numerical operations is achieved by gesture, moving an image or pressing a button.

* * * * *